United States Patent [19]

Glass, Jr.

[11] 4,227,585

[45] Oct. 14, 1980

[54] ROTATING STABILIZER FOR SHAFT DRILLING

[75] Inventor: Joseph M. Glass, Jr., Houston, Tex.

[73] Assignee: Hughes Tool Company, Houston, Tex.

[21] Appl. No.: 974,206

[22] Filed: Dec. 28, 1978

[51] Int. Cl.[2] ..... E21B 7/10

[52] U.S. Cl. ..... 175/325; 308/4 A

[58] Field of Search ..... 175/320, 53, 399, 408, 175/171, 325, 323, 324; 308/4 A

[56] References Cited

U.S. PATENT DOCUMENTS

| | | | |
|---|---|---|---|
| 1,721,004 | 7/1929 | Debose | 175/325 |
| 1,848,762 | 3/1932 | Atkinson | 175/325 X |
| 2,234,451 | 3/1941 | Ransome | 175/325 |
| 2,495,073 | 1/1950 | Morris | 175/325 X |
| 3,383,946 | 5/1968 | Justman | 175/320 X |
| 4,133,397 | 1/1979 | Tschirky | 175/325 |

*Primary Examiner*—James A. Leppink
*Assistant Examiner*—Richard E. Favreau
*Attorney, Agent, or Firm*—Robert A. Felsman

[57] ABSTRACT

A stabilizer for maintaining a drill string centered during large diameter earth boring. The stabilizer includes a ring with a continuous outer surface. The ring is mounted to the drill string so that it rotates with the drill pipe, its outer surface being in sliding contact with the shaft wall. The mounting system includes an inner plate carried by the drill string. The plate has protruding tabs that mate with tabs attached to the ring. The mating tabs support the ring and allow it to be easily uncoupled.

5 Claims, 3 Drawing Figures

13
19
21
29
39
49
37
41
27
53
33
25
11
11
23
17
15

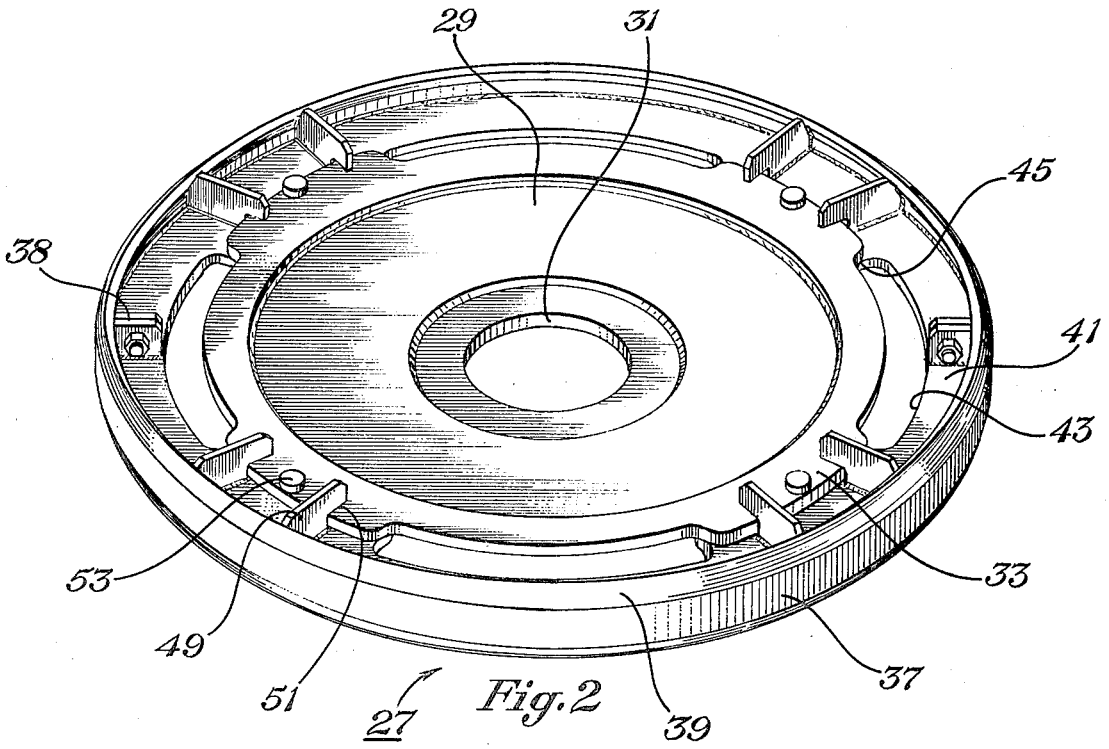
Fig. 2
Fig. 3
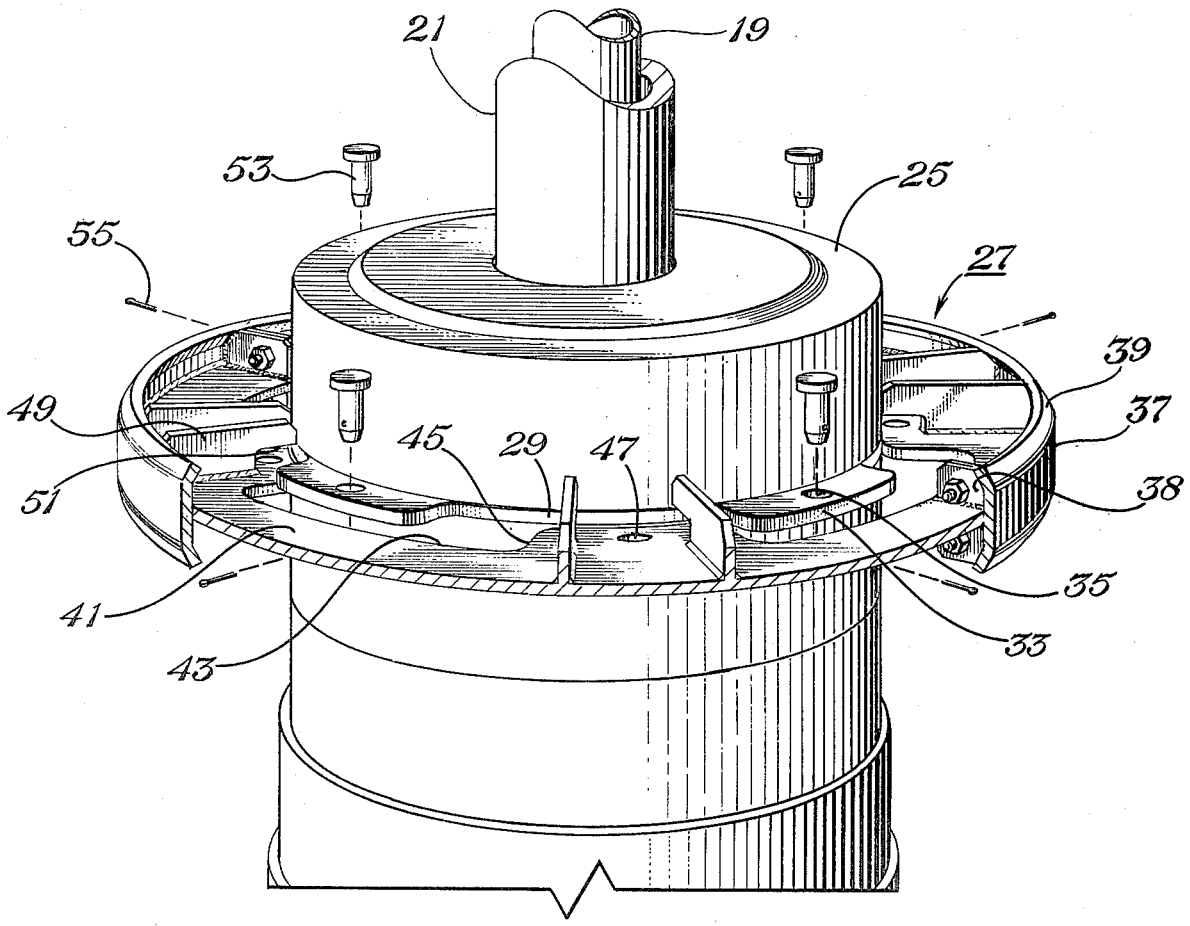

ROTATING STABILIZER FOR SHAFT DRILLING

BACKGROUND OF THE INVENTION

1. Field of the Invention

This invention relates in general to earth boring equipment and in particular to a stabilizer for centralizing the drill string in shaft boring.

2. Description of the Prior Art

In the drilling of large diameter wells or shafts, which may be four feet to twenty feet or so in diameter, it is important to center the drill string in the shaft, the typical drill pipe being only about 16 inches in diameter. One prior stabilizer has a frame extending outward from the pipe. A number of vertical cylinders or rollers are mounted on bearings at the edge of the frame. The frame rotates in unison with the drill string, and the rollers engage the shaft wall in rolling contact.

One disadvantage of this type of stabilizer is that it is expensive to construct. Also the bearings in the rollers require maintenance. Another disadvantage is in disassembling the stabilizer. When pulling the string from the well, frequently the opening in the rig floor is of lesser diameter than the drill bit. There is sufficient clearance between the rig floor and the earth's surface to remove the bit from the shaft and perform the necessary operations on it below the rig floor. The stabilizer, which is normally several feet above the drill bit, however, must be first disassembled since there is normally not enough clearance for both the assembled stabilizer and bit to be drawn into the space beneath the rig floor.

SUMMARY OF THE INVENTION

It is accordingly a general object of this invention to provide an improved stabilizer for shaft drilling.

It is a further object of this invention to provide an improved stabilizer for shaft drilling that does not have bearings.

It is a further object of this invention to provide an improved stabilizer for shaft drilling that is easily uncoupled from the drill string.

In accordance with these objects, a stabilizer is provided that includes a cylindrical ring of diameter approximately equal to the shaft. The ring is mounted to the drill string so that it rotates with it. The outer surface of the ring is cylindrical and slidingly engages the shaft wall. The mounting system includes a plate located below one or more of the weights on the drill string. The plate has outwardly protruding tabs that mate with tabs attached to the ring. The tabs are pinned together to support the ring. Removing the pins from the tabs allow the ring to be uncoupled from the plate.

BRIEF DESCRIPTION OF THE DRAWINGS

FIG. 2 is a perspective view of the stabilizer of FIG. 1, shown in coupled position.

FIG. 3 is a perspective view, partially broken away, of the stabilizer of FIG. 1, shown in decoupled position.

DESCRIPTION OF THE PREFERRED EMBODIMENT

Figure 1:
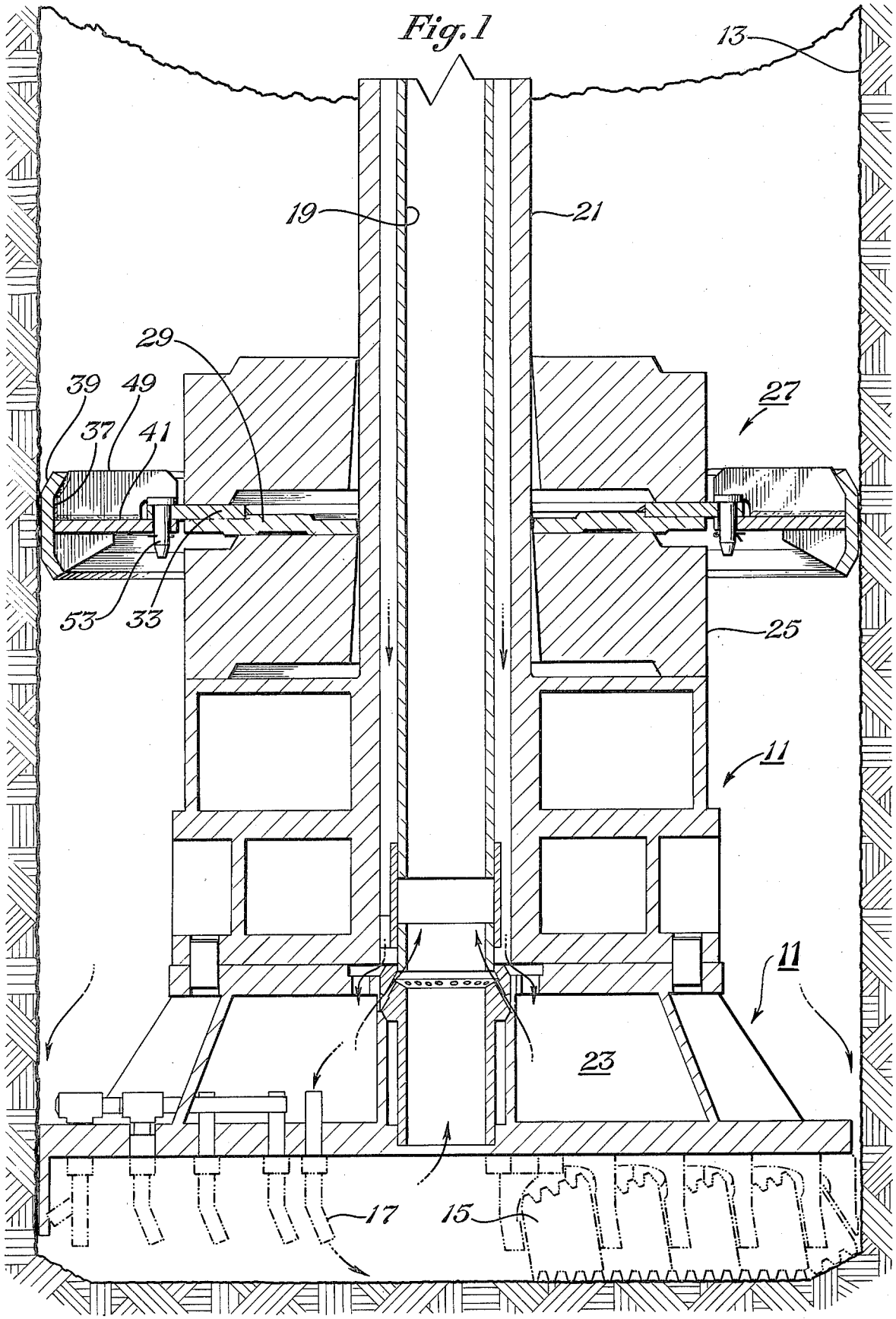
FIG. 1 is a vertical sectional view of a shaft drill bit partially shown in phantom and having a stabilizer constructed in accordance with this invention.

Referring to FIG. 1, an earth boring drill bit 11 is shown in shaft 13. The drill bit 11 is of a conventional type having a plurality of cutters 15 mounted to its bottom. Each cutter 15 is rotatable and has rows of steel teeth or tungsten carbide inserts for disintegrating the earth formations. Cutters 15 may also be disks as shown in U.S. Pat. No. 3,905,432. A plurality of nozzles 17 are mounted to the drill bit bottom for discharging fluid against the bottom of the shaft. The cutters 15 and nozzles 17 are shown in phantom and are rotated into the plane of the section to show their respective distances from the center of the drill bit.

The drill bit 11 is connected to a string of drill pipe for rotation therewith. The string comprises sections of inner pipe 19 mounted inside sections of outer pipe 21. Fluid, often a mixture of air and water, is pumped down the annular passage between the inner and outer pipes and into a separation chamber 23. As indicated by the arrows in FIG. 1, the air and water separate, with the air returning up the inner passage to lighten the weight of the column, and the water being discharged out the nozzles. The water discharged out of the nozzles combines with downwardly flowing water from the shaft, the combined stream being returned up the inner pipe along with the cuttings.

Several cylindrical weights 25 are mounted above the bit to apply force for cutting. The weights 25 are each formed in two semi-cylindrical portions and then connected together on the drill string. Although only two are shown in the drawing, ten or more weights are commonly stacked in the string.

A stabilizer 27 is placed in the stack of weights 25. It may be located at any point above the bit, and is normally five feet to fifty feet from the bottom of the shaft. In some cases, two stabilizers may be used, one near the bottom of the weights and one near the top. Referring to FIGS. 2 and 3, the stabilizer 27 includes an inner member or a plate 29 that is inserted below one or more weights 25. Inner plate 29 has a circular hole 31 in the center for receiving the outer pipe 21. Inner plate 29 is circular and is of the same diameter as the weights 25.

Four projections or tabs 33 are formed on inner plate 29. Tabs 33 are spaced apart 90°, with the circumferential length of each being less than the circumferential length of the spaces between the inner tabs. Each tab 33 projects radially beyond the outer wall of the weight 25 above it. A hole 35 extends through the center of each inner tab 33.

Stabilizer 27 also includes a metal ring 37. Ring 37 has a cylindrical perimeter adapted to slidingly contact the wall of shaft 13. The axis of ring 37 is concentric with the longitudinal axis of the drill string. Ring 37 is formed in two semi-cylindrical segments and bolted together by flanges 38. The upper and lower edges 39 of ring 37 are bent inwardly or chamfered to reduce scraping of the shaft 13 while moving the drill string vertically. The diameter of ring 37 is selected to be substantially that of the shaft 13, preferably about two inches less in diameter.

An outer member or plate 41 is welded to the inner wall of ring 37. Outer plate 41 lies in a plane perpendicular to the axis of the drill string. Outer plate 41 has an inner opening 43 that is larger in diameter than the distance from the outer edge of one tab 33 to the outer edge of the tab 33 on the opposite side. Outer plate 41 has four projections or tabs 45 extending radially inward. Tabs 45 are the same circumferential length as tabs 33, and are spaced apart 90° from each other. The distance between two opposing tabs 45 is slightly greater than the diameter of weights 25. Tabs 45 have holes 47 through them that align with holes 35 when the tabs 33 and 45 are aligned as shown in FIG. 2.

Each tab 45 has a pair of retaining members or lugs 49 secured to its upper side. Each lug 49 lies in a radial plane of the drill string axis. Each lug 49 has a clearance or slot 51 below it for receiving one of the tabs 33. The inner end of lug 49 extends inward to approximately the same point as the tab 45. Slot 51 is of sufficient height to accommodate one of the tabs 33. The lugs 49 on each tab 45 are located on each side of hole 47. A pin 53 is adapted to be inserted through each hole 35 and 47. Pin 53 is locked by cotter pin 55.

In operation, the stabilizer is initially assembled by placing plate 29 over the drill string and onto a weight 25. The two halves of ring 37 are placed around the weights 25 and bolted together at flanges 38. Ring 37 is rotated until tabs 33 pass into slots 51 and, holes 47 are aligned with holes 35. Pins 53 are then inserted through the holes, and locked by cotter pins 55. Additional weights 25 are placed on top. Lugs 49 support the weight of the ring 37, and along with tabs 45, prevent vertical movement of the ring with respect to the drill string. The tabs 33, 45, lugs 49 and pins 53 and 55 serve as mounting means for coupling the ring 37 to the drill string.

The bit is lowered to the bottom of the shaft and rotated. The load from the weights 25 above the stabilizer passes through plate 29. The frictional effect of this load causes the inner plate 29 and ring 37 to rotate in unison with the drill string, although there may be slight slippage or sliding of plate 29 from time to time. The exterior of ring 37 slidingly contacts the wall of shaft 13, maintaining the drill string in the center of the shaft. Liquid in the shaft passes downwardly through the space or passage means between the weight 25 and inner edge of the outer plate 41.

When removing the drill bit from the shaft, once the stabilizer has been pulled above the surface of the shaft, pins 53 are removed. The ring 37 is then rotated until tabs 45 are out of alignment with tabs 33. The two halves of ring 37 are uncoupled at flanges 38 and withdrawn. The string is pulled up until the drill bit is completely above the surface. If desired, the two halves of the ring 37 may remain bolted together after uncoupling tabs 45 from tabs 33. The ring is rotated until tabs 45 do not interfere with tabs 33 as shown in FIG. 3. Ring 37 is then supported by various means while the drill string is drawn upward to expose the drill bit.

It should be apparent that an invention having significant advantages has been provided. The stabilizer is of simple construction, having no bearings and requiring little maintenance. It is easily uncoupled for pulling the bit from the shaft.

While the invention has been shown in only one of its forms, it should be apparent to those skilled in the art that it is not so limited but is susceptible to various changes and modifications without departing from the spirit thereof. For example the outer plate 41 may be eliminated, with individual tabs 45 welded to the inner wall of the ring.

I claim:

1. In an apparatus for drilling large diameter shafts of the type having a drill bit secured to the end of a string of drill pipe, the drill bit having a plurality of rotatable cutters, and a plurality of weights carried on top of the drill bit, an improved means for centering the drill string in the shaft, comprising:

a metal ring of diameter substantially that of the shaft;

mounting means for mounting the ring to the drill string so that the ring rotates in unison with the drill string, the ring having a perimeter in sliding contact with the wall of the shaft, the mounting means including an inner member carried with the shaft for rotating therewith, the ring being rigidly and releasably coupled to the inner member so that it can be disengaged from the inner member when pulling the bit to the surface; and passage means in the mounting means for allowing fluid in the shaft to flow past the ring.

2. In an apparatus for drilling large diameter shafts of the type having a drill bit secured to the end of a string of drill pipe, the drill bit having a plurality of rotatable cutters, and a plurality of weights carried on top of the drill bit, an improved means for centering the drill string in the shaft, comprising:

a metal ring of diameter substantially that of the shaft;

mounting means for mounting the ring to the drill string, the mounting means having an inner member inserted below one of the weights, the ring being rigidly coupled to the inner member, the force exerted by the weight causing the ring to rotate in unison with the drill string, the ring having a perimeter in sliding contact with the wall of the shaft; and passage means in the mounting means between the ring and the weight for allowing liquid in the shaft to flow past.

3. In a downhole apparatus for drilling large diameter shafts of the type having a drill bit secured to the end of a string of drill pipe, the drill bit having a plurality of rotatable cutters, and a plurality of weights carried on top of the drill bit, an improved means for centering the drill string in the shaft, comprising:

a metal ring of diameter substantially that of the shaft, and having a cylindrical perimeter adapted to slidingly engage the wall of the shaft;

a plate encircling the drill string and mounted below one of the weights, the force exerted by the weight causing the plate to rotate in unison with the drill string, the plate having a plurality of tabs extending outward past the periphery of the weight above it, the tabs being spaced apart;

a plurality of tabs rigidly carried by the inner wall of the ring, being spaced apart and adapted to align with the plate's tabs; and means for securing the ring's tabs together with the plate's tabs to support the ring with the plate.

4. In an apparatus for drilling large diameter shafts of the type having a drill bit secured to the end of a string of drill pipe, an improved means for centering the drill string in the shaft, comprising:

a ring of diameter substantially that of the shaft, the ring having a cylindrical outer surface;

a plate carried by the drill string for rotation therewith, the plate having a plurality of tabs extending outwardly, the tabs being spaced apart and each having a hole therethrough;

a plurality of tabs rigidly carried by the inner wall of the ring, being spaced apart and each having a hole therethrough that is adapted to align with a hole in one of the plate's tabs;

a plurality of retaining members carried by the inner wall of the ring, each having a slot located between it and one of the ring's tabs to accommodate one of the plate's tabs therebetween; and a pin adapted to be placed through the aligned holes of each plate and ring tab to cause the ring to rotate with the plate;

the spaces between the plate's tabs and the spaces between the ring's tabs being greater in circumferential length than the circumferential length of each plate and ring tab, allowing the ring to be uncoupled from the plate by withdrawing the pins and rotating the ring so that the plate ad ring tabs are no longer in alignment.

5. In an apparatus for drilling large diameter shafts of a type having a drill bit secured to the end of a string of drill pipe, and a plurality of cylindrical weights carried on top of the drill bit, an improved means for centering the drill string in the shaft, comprising:

a ring of diameter substantially that of the shaft, the ring being of two segmental halves bolted together and having a cylindrical outer surface;

a plate encircling the drill string and mounted below at least one of the weights, the force exerted by the weight causing the plate to rotate in unison with the drill string, the plate having a circular periphery with an outer diameter substantially equal to the diameter of the weights and a plurality of tabs extending outward past the periphery of the weight, the tabs being equally spaced apart and each having a hole therethrough;

a plurality of tabs rigidly carried by the inner wall of the ring, extending inwardly, and being equally spaced apart, each having a hole therethrough adapted to align with one of the holes in one of the plate's tabs;

a pair of upright lugs carried by the inner wall of the ring above each of the ring's tabs, each lug having a slot between it and the upper surface of the ring's tab to allow one of the plate's tabs to be inserted between the lug and the ring's tab, the lugs supporting the weight of the ring; and a plurality of pins adapted to be placed through the aligned holes of the plate and ring tabs to cause the ring to rotate with the plate;

the circumferential spaces between the plate's tabs being sufficient to accommodate the ring's tabs, allowing the ring to be decoupled by withdrawing the pins and rotating the ring until the plate and ring tabs do not interfere with each other.

* * * * *